US011517084B2

(12) United States Patent
Krainz

(10) Patent No.: US 11,517,084 B2
(45) Date of Patent: Dec. 6, 2022

(54) BEZEL SETTING WITH COLOR ENHANCEMENT LAYER

(71) Applicant: Krainz Creations, INC., New York, NY (US)

(72) Inventor: Roland Krainz, Brookfield, CT (US)

(73) Assignee: Krainz Creations, Inc., New York, NY (US)

( * ) Notice: Subject to any disclaimer, the term of this patent is extended or adjusted under 35 U.S.C. 154(b) by 75 days.

(21) Appl. No.: 17/110,655

(22) Filed: Dec. 3, 2020

(65) Prior Publication Data

US 2021/0161260 A1 Jun. 3, 2021

Related U.S. Application Data

(60) Provisional application No. 62/942,870, filed on Dec. 3, 2019.

(51) Int. Cl.
*A44C 17/02* (2006.01)
*A44C 27/00* (2006.01)

(52) U.S. Cl.
CPC ..... *A44C 27/001* (2013.01); *A44C 17/02* (2013.01)

(58) Field of Classification Search
CPC . B23P 5/00; A44C 17/04; A44C 17/02; A44C 27/001; A44C 17/001; A44C 17/00
USPC ..... 63/26–27
See application file for complete search history.

(56) References Cited

U.S. PATENT DOCUMENTS 3,605,442 A * 9/1971 Parker ..... A44C 17/04 63/26
8,365,553 B2 2/2013 Huynh
2006/0009540 A1 1/2006 Jia et al.
2015/0075217 A1* 3/2015 Disinger ..... A44C 15/0015 63/1.11
2017/0231336 A1* 8/2017 Disinger ..... A44C 15/0015 63/1.13
2019/0192257 A1 6/2019 Hosokawa et al.

FOREIGN PATENT DOCUMENTS

GB 356084 A * 3/1931 ..... A44C 17/02
GB 2136672 A * 9/1984 ..... A44C 17/02
KR 20090079679 A * 7/2022 ..... A44C 17/02

OTHER PUBLICATIONS https://jentner.de/en/electro-plating-products/vivacolor/, accessed Sep. 17, 2019, 4 pages.

* cited by examiner

*Primary Examiner* — Jack W Lavinder
(74) *Attorney, Agent, or Firm* — FisherBroyles, LLP; Susan M. Oiler

(57) ABSTRACT

Jewelry bezel settings have a band defining an aperture shaped to receive a stone. The band has a flange defining an upper opening and a pavilion-facing interior surface defining a lower opening. The flange extends radially inward a pre-selected distance to sit on a top edge of a girdle of the stone, and the pavilion-facing interior surface is angled to seat against facets of the stone. A channel is formed in and extends around an interior perimeter of the band between the flange and the pavilion-facing interior surface, and a cured material fills the channel and defines a plurality of pavilion facet-mating surfaces. The cured material defines a layer having a preselected color selected to enhance a brilliance of the stone.

23 Claims, 4 Drawing Sheets

BEZEL SETTING WITH COLOR ENHANCEMENT LAYER

RELATED APPLICATIONS

This application claim the benefit of U.S. Provisional Application No. 62/942,870, filed Dec. 3, 2019, the entirety of which is incorporated herein by reference.

TECHNICAL FIELD

The present application relates generally to jewelry and, more particularly, to a bezel setting having an interior surface having a cured layer of colored material that has a color that enhances the stone and enables setting a stone with facets therein.

BACKGROUND

A bezel setting is essentially a metal band that wraps around a stone. A bezel setting is stronger and more secure than a prong or channel setting but allows much less light through the stone. This reduces its brilliance and may affect its appeal.

Bezel settings are typically used with cabochons, which are polished but non-faceted stones, or with smaller, less perfect stones to make their imperfections less noticeable.

There is a need to improve bezel settings to receive faceted stones and to enhance (rather than detract from) their brilliance in order to utilize this stronger, more secure setting.

SUMMARY

In all aspects, jewelry bezel settings are disclosed that have a band defining an aperture shaped to receive a stone and having a flange defining an upper opening and a pavilion-facing interior surface defining a lower opening. The flange extends radially inward a pre-selected distance to sit on a top edge of a girdle of the stone and the pavilion-facing interior surface is angled to seat against facets of the stone. Also, the band defines a channel that extends around an interior perimeter of the band between the flange and the pavilion-facing interior surface. The jewelry bezel settings have a cured material filing the channel and defining a plurality of pavilion facet-mating surfaces. The cured material defines a layer having a preselected color selected to enhance a brilliance of the selected stone.

In all aspects, the cured material comprises an acrylic or methacrylic resin or a ceramic, both of which were cured by visible light or UV light. In one embodiment, the cured material is a blend of acrylic or methacrylic resins. In one embodiment, the cured material is a dental composite.

In all aspects, the lower opening defines a smaller area than an area of the upper opening.

In another aspect, jewelry pieces of all shapes and sizes are disclosed herein. The jewelry pieces have a shank, a post, a bail, or a wristband and a jewelry bezel setting disclosed herein attached thereto, and a stone seated in the aperture defined by the band of the jewelry bezel setting. The jeweler piece can be a ring, a pin, a broach, earrings, pendants, necklace, watch, bracelet, etc.

In another aspect, methods of making the jewelry bezel settings are disclosed. The methods include selecting a stone, forming a band defining an aperture to receive the stone, wherein the band has an upper opening and has a stone-facing interior surface defining a lower opening, forming a channel within the interior stone-facing surface that extends around the interior perimeter of the band, thereby forming a flange proximate the upper opening that extends radially inward a preselected distance to seat the flange on a top edge of a girdle of the stone and forming a pavilion-facing interior surface, placing a curable material in the channel, seating the stone in the band with the flange on a top edge of the girdle with the girdle and the pavilion facets in direct contact with the curable material, and curing the curable material with the stone seated in the band. Additionally, the method can include removing the stone and repeating the action of placing a curable material in the channel, seating the stone in the band as noted above, and curing the curable material with the stone seated in the band. This can be repeated as many times as needed to fill the channel with the cured material.

In all aspects, the stone may be a diamond or a gemstone, and may be generally circular, oval, octagonal, pear, rectangular, or square at the girdle.

In all aspects, placing the curable material in the channel comprises introducing the curable material thereto as a liquid and curing the curable material includes applying UV or visible light to the curable material. The liquid is introduced by brushing the liquid in the channel with a brush, injecting the liquid into the channel with a syringe, daubing the liquid into the channel with a dauber, or filling the channel using a spatula, or injecting the liquid into the channel through a bore that extends from an exterior of the surface of the band to the channel.

In all aspects, forming the band includes casting the band from a mold, soldering a wire into a ring, or 3D printing the band. Then, forming the channel includes engraving or etching the channel into the stone-facing interior surface of the band or defining the channel using 3D software for a mold or for 3D printing of the band.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present system.

DETAILED DESCRIPTION

Figure 1:
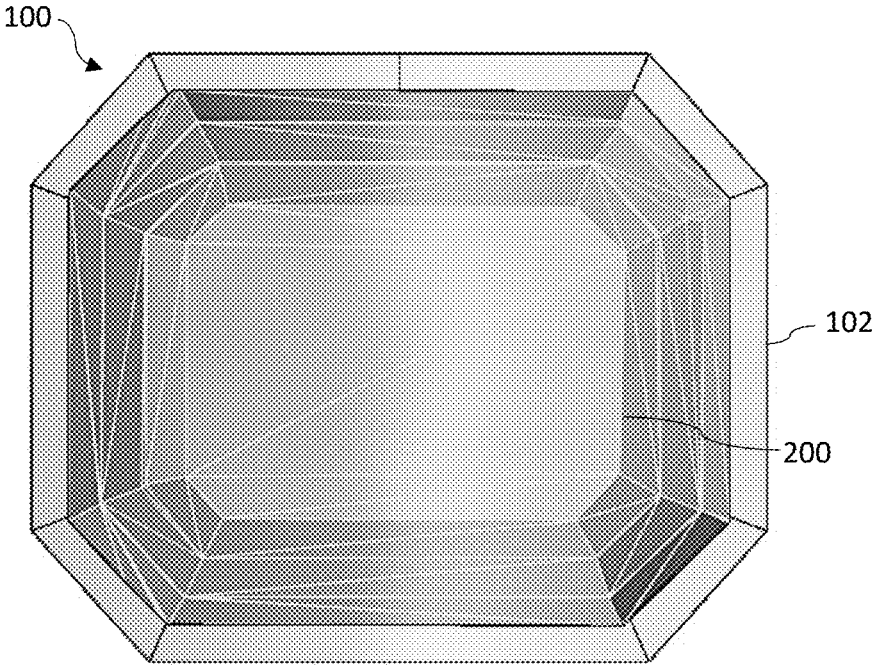
FIG. 1 is a top, plan view of a bezel setting with an octagonally-shaped stone according to the example embodiment.

The following detailed description will illustrate the general principles of the invention, examples of which are additionally illustrated in the accompanying drawings. In the drawings, like reference numbers indicate identical or functionally similar elements.

While an octagonally-shaped stone was used for the drawings of the patent application, the shape of the bezel setting is in no way limited thereto. The stone may be round, oval, pear, square, traditional diamond shaped, etc.

Figure 2:
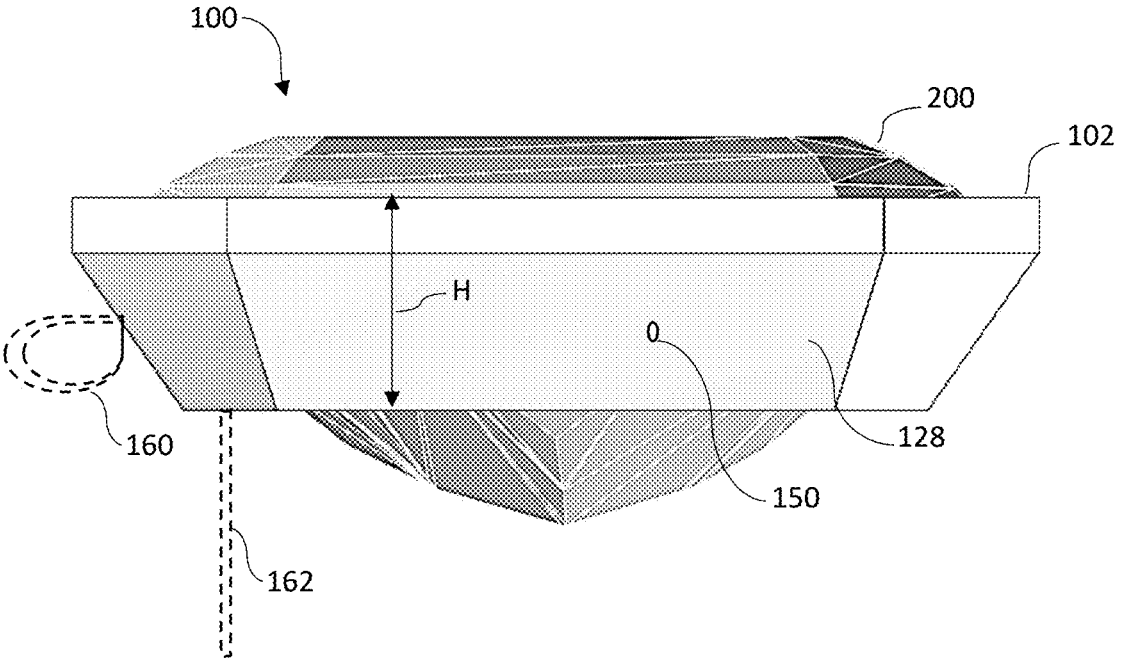
FIG. 2 is a side view of the bezel setting of FIG. 1.
Figure 3:
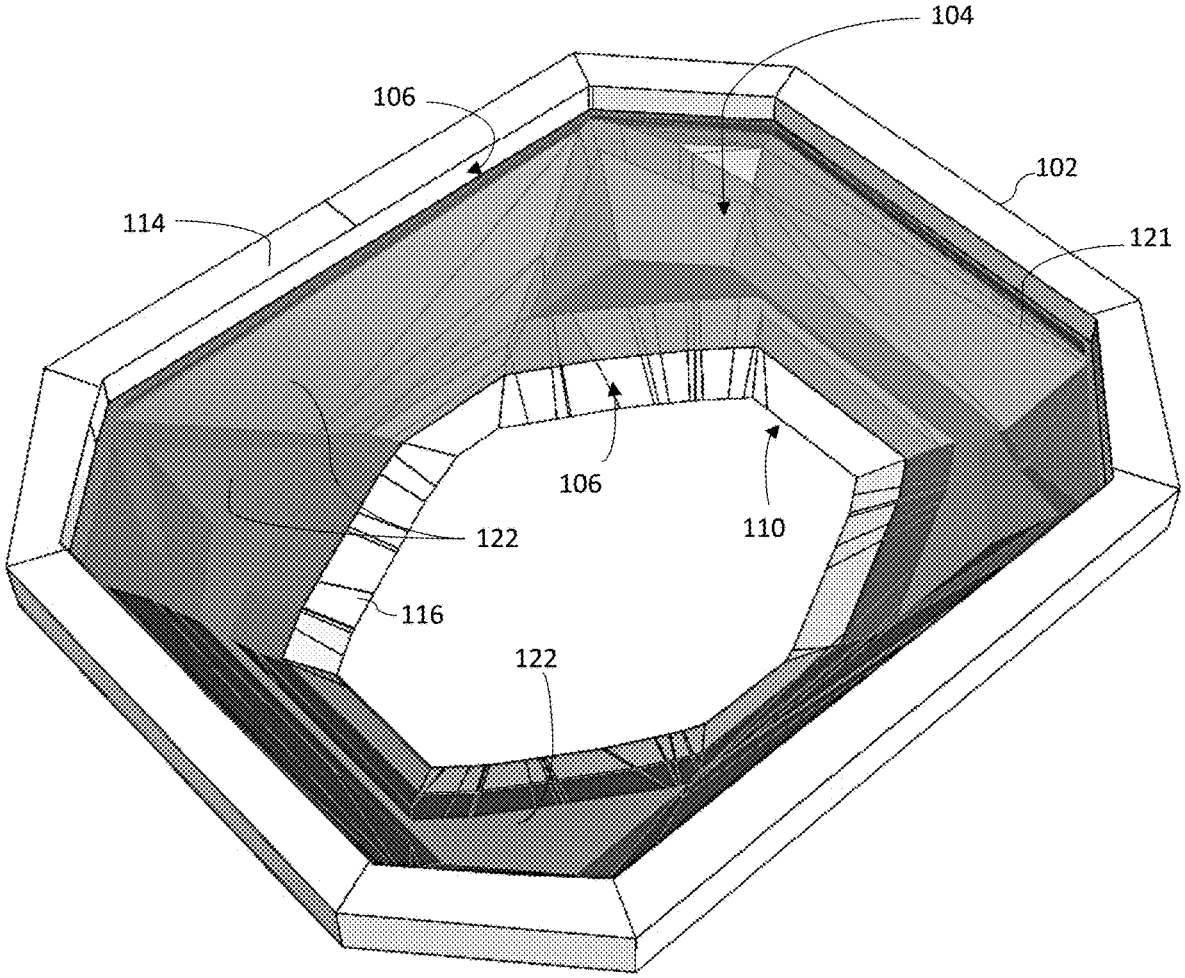
FIG. 3 is a top, perspective view of one example embodiment of a bezel setting without a stone.

Turning to FIGS. 1-4, a bezel setting, generally referred to by reference number 100, has a band 102 defining an aperture 104 (FIG. 3) shaped to receive a stone 200 and having a flange 114 defining an upper opening 106 and a pavilion-facing interior surface 116 defining a lower opening 110. The flange 114 extends radially inward a pre-selected distance to sit on a top edge of a girdle 202 of the stone 200 (FIG. 4) and the pavilion-facing interior surface 116 is angled to seat against a plurality of facets 204, in particular pavilion facets 204, but optionally pavilion facets 204 and/or break facets 206, of the stone 200 depending upon the cut of the stone and the height (H) of the band 102, and defining a channel 112 within the band that extends around an interior perimeter of the band 102 between the flange 114 and the pavilion-facing interior surface 116. As shown in FIG. 3, the lower opening 110 defines a smaller area than an area of the upper opening 106.

Figure 4:
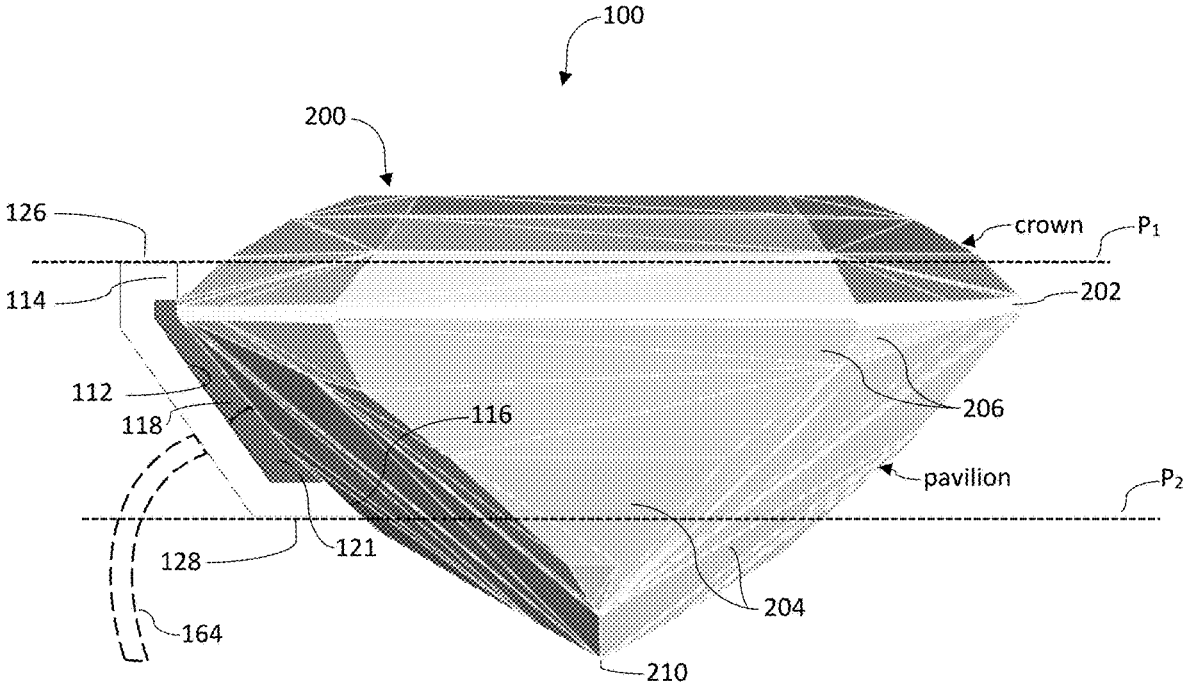
FIG. 4 is a partial side, plan view of the bezel setting of FIG. 3 with a full stone.

As best seen in FIGS. 3 and 4, a cured material 121 fully fills the channel 112 and defines a plurality of pavilion facet-mating surfaces 122. The cured material 121 is not visible from a top, side, or bottom view of the setting or jewelry piece. In other words, the cured material is fully contained within the interior of the band 102. The cured material provides color reflectance of light entering the stone to enhance the brilliance of the stone by being color-matched to the stone. For example, if the stone is a pink diamond, then the cured material will have a hue pre-selected to enhance the color of the pink diamond, which may be a pink hue that is color-matched to the stone, but is not limited thereto. Turning to FIG. 4, the bezel setting 100 sets a stone therein with a portion of the crown protruding beyond a plane ($P_1$) defined by the upper surface 126 of the band 102 and the culet 210 and a portion of the pavilion protrude beyond a plane ($P_2$) defined by the bottom surface 128 of the band 102. The portions of the stone protruding from the band 102 allow light to pass through the stone 200 to reach the cured material 121 and to be reflected back through the stone 200 to the eye of a viewer of the jewelry setting 100.

Curable Material

The curable material comprises an acrylic resin and/or a ceramic and is curable by exposure to visible light or UV light. The visible light may be a blue light. One example of a curable material is Vivacolor colored acrylic resin available from Jentner Plating Technology of Germany. The Vivacolor colored acrylic resin is available in at least the following colors, which may be blended to achieve an unlimited number of preselected colors: red, orange yellow, green, blue, white, black, transparent, and some even have a sparkle effect.

Another example of curable material is dental composite materials for filling a tooth, which can be color matched to the existing teeth of a patient. Dental composite fillings are typically a mixture of acrylic resins (acrylate or methacrylate resins) and fillers. Desirable here are dental composites that are curable by UV light or visible light. The fillers generally comprise inorganic materials based on silica, silicate based glasses, or quarts. The glass-like powder can be a ceramic filler such as, but not limited to, zirconia-silica and zirconium oxide. Some other dental composite materials comprise epoxides or epoxy/methacrylate containing compounds. See for example, U.S. Patent Application Publication 2006/0009540 and U.S. Patent Application Publication 2019/0192257.

Turning again to FIG. 2, the jewelry setting 100 may be a pendent because of the presence of a bail 160 or may be an earring or a pin because of the presence of a post 162, or any other piece of jewelry.

Turning again to FIG. 4, the jewelry setting 100 may be a ring because of the presence of a shank 164. In other embodiments, the jewelry setting 100 may be part of a watch band, brooch, or any other piece of jewelry.

In all the embodiments herein, the stone can be a diamond, a gemstone, or a man-made stone. The stone may be circular, oval, octagonal, pear, rectangular, or square at the girdle, but is not limited thereto.

Figure 5:
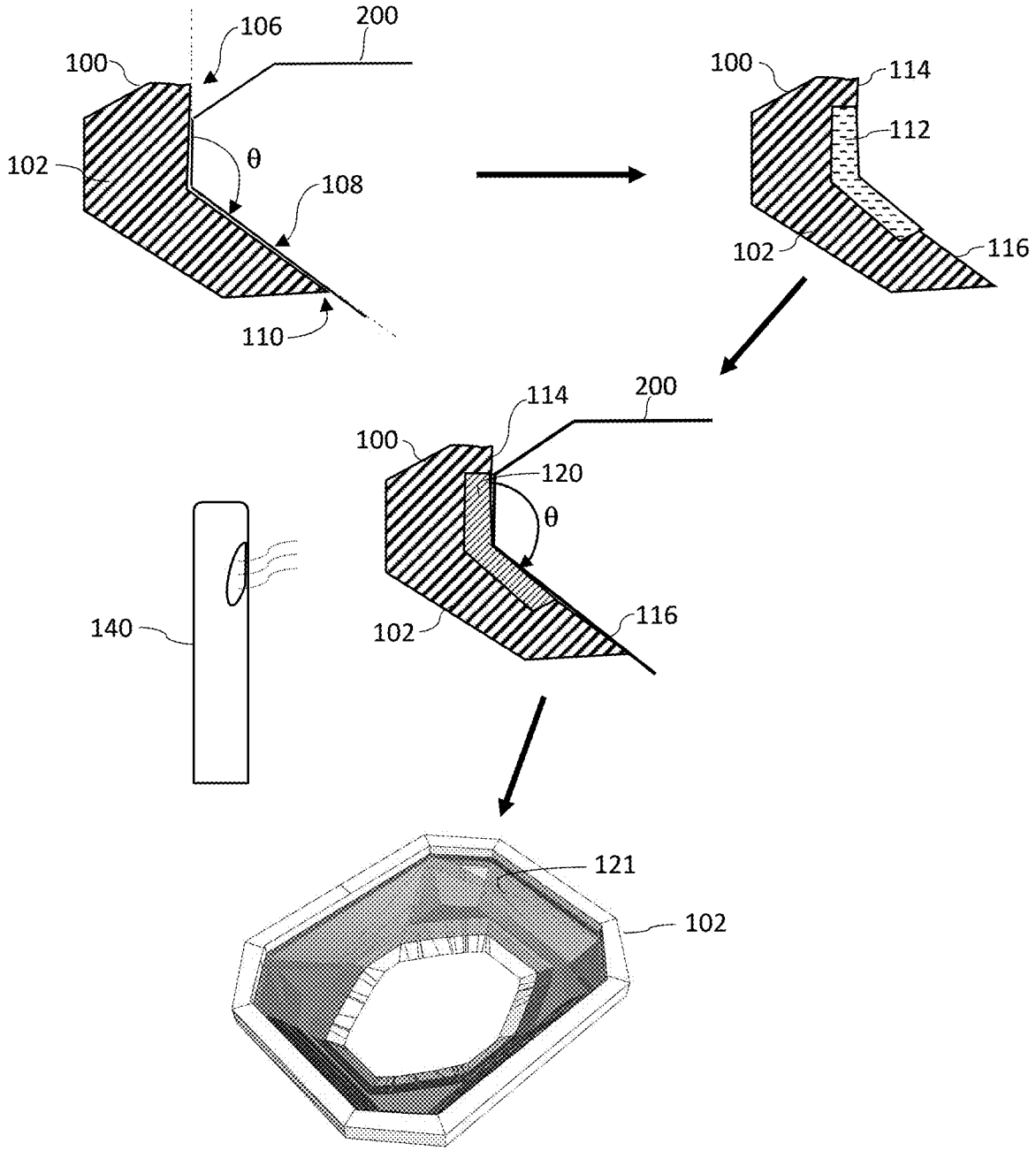
FIG. 5 is a partial side, plan view of one method for making a bezel setting.

Referring now to FIG. 5, a method for making a jewelry bezel setting is illustrated. A stone 200 is selected for a setting 100. The stone 200 is scanned with a 3-D scanner. Based on the 3-D scan, a band 102 defining an aperture 104 shaped to receive the selected stone 200 is made that has an upper opening 106 and a stone-facing interior surface 108 defining a lower opening 110. The band and other jewelry is typically made of metal, such as gold, silver, white gold, platinum, or any metal useful for making jewelry, but is not limited thereto. In other embodiment, the band and other jewelry may be made of any other, non-metal material useful for jewelry.

Then, a channel 112 is formed in the interior stone-facing surface 108, thereby forming a flange 114 proximate the upper opening 106 and forming a pavilion-facing interior surface 116 proximate the lower opening 110. The flange 114 extends radially inward a pre-selected distance to sit on a top edge of a girdle 202 of the stone 200. The pavilion-facing surface 116 has a plurality of angled faces (shown in FIG. 3) defining a seat for the plurality of facets 204 of the stone 200. The channel 112 within the band 102 extends around the interior perimeter of the band 102 between the flange 114 and the pavilion-facing interior surface 116 and defines a gap 118 (FIG. 4) between the girdle of the stone and a portion of the pavilion of the stone just below the girdle and the surface of the channel 112 that is radially outward from the stone.

The band 100 may be cast from a mold formed based on the 3-D scan with the channel 112 present or by 3D printing. The channel 112 is formed in the interior stone-facing surface 108 of the band by cutting, etching, engraving, and scraping to remove material from the band 102 or using 3D CAD software such that the channel is formed during molding or 3D printing to remove material from the band 102.

Still referring to FIG. 5, the interior surface 108 of the band 102 has two faces defining an obtuse angle (θ) and the channel 112 filled with cured material defines part of both faces and defines the obtuse angle (θ). The channel 112 is recessed into the interior surface 108 of the band to have a depth that is less than the thickness of the band.

Before the stone 200 is placed in the band 102, a curable material 120 is introduced into the channel 112. The curable material 120 may be a liquid as described above. The channel 112 is filled with the curable material 120. Then, the stone 200 is inserted into the band 102 into direct contact with the curable material 120, such that the curable material 120 forms to the shape of the exterior of the stone 200. Next, a UV- or visible-light source 140, such as a blue light source, is placed proximate the band 102, with the stone seated therein, and is activated to cure the curable material. Curing for about 30 seconds to about 3 minutes should be sufficient. A cured material 121 results from exposure to the UV- or visible-light source 140. The cured material 121 defines a layer that has a color preselected to enhance the brilliance of the stone. For example, if the gemstone is green, the cured material is a shade of green that enhances the brilliance of the stone or if the stone is a pink diamond, the cured material is a shade of pink that enhances the brilliance of the stone.

The stone 200 is removed post-curing from the setting to verify that the curable material is fully cured and to verify that the channel 112 is filled and each facet-mating surface 122 of the cured material has been fully formed. If not fully cured, the UV or visible light source is re-activated to finish curing the curable material. If the channel 112 is not filled or each facet-mating surface 122 is not fully formed, then additional curable material is placed in the deficient spaces, the stone seated once again in the band, and the UV- or visible-light source is activated again. These steps may be repeated as many times as needed to fully form each facet-mating surface 122.

In one embodiment, the channel 112 is filled by introducing material into channel via the top opening 104 using a syringe, brush, spatula, dauber, or other appropriately shaped tool. The curable material may be warmed before introduction into the channel for improved flowability, such as rendering the curable material into its liquid state or into a semi-solid state. As such, the liquid or semi-solid material may be introduced by brushing the liquid in the channel with a brush, injecting the liquid into the channel with a syringe, daubing the liquid into the channel with a dauber, or filling the channel using a spatula, but is not limited thereto.

Referring now to FIG. 2, in another embodiment, the method may include introduction of the curable material 121 through a hole 150 in the band 102 that extends from an exterior surface 128 into the channel 112. The curable material 120 is injected through hole 150 when the stone is seated in the band 102. Then, the curable material 120 is cured by application of the UV- or visible-light source 140 as described above. This process may be repeated as many times as needed to fill the channel 112 with the cured material.

The method may also include the application of one or more linking and/or bonding agents, which may also be UV- or visible-light curable, before application of the curable material 120 that has the preselected color.

Although various aspects of the disclosed ring sizing system have been shown and described, modifications may become apparent to those skilled in the art upon reading the specification. The present application includes such modifications and is limited only by the scope of the claims.

What is claimed:

1. A jewelry bezel setting, comprising:

a band defining an aperture shaped to receive a stone and having a flange defining an upper opening and a pavilion-facing interior surface defining a lower opening, wherein the flange extends radially inward a preselected distance to sit on a top edge of a girdle of the stone and the pavilion-facing interior surface is angled to seat against facets of the stone, and defining a channel within the band that extends around an interior perimeter of the band between the flange and the pavilion-facing interior surface; and a cured material filing the channel and defining a plurality of pavilion facet-mating surfaces.

2. The jewelry bezel setting of claim 1, wherein the cured material defines a layer having a preselected color selected to enhance a brilliance of the stone.

3. The jewelry bezel setting of claim 2, wherein the cured material comprises an acrylic resin.

4. The jewelry bezel setting of claim 3, wherein the acrylic resin is cured by visible light or UV light.

5. The jewelry bezel setting of claim 3, wherein the cured material comprises a blend of acrylic resins making the preselected color.

6. The jewelry bezel setting of claim 5, wherein the acrylic resin is cured by visible light or UV light.

7. The jewelry bezel setting of claim 2, wherein the cured material comprises a ceramic or a resin.

8. The jewelry bezel setting of claim 1, wherein the lower opening defines a smaller area than an area of the upper opening.

9. A jewelry piece comprising:

a jewelry base;

a jewelry bezel setting attached to the jewelry base, the jewelry bezel comprising:

a band defining an aperture shaped to receive a stone and having a flange defining an upper opening and a pavilion-facing interior surface defining a lower opening, wherein the flange extends radially inward a pre-selected distance to sit on a top edge of a girdle of the stone and the pavilion-facing interior surface is angled to seat against facets of the stone, and defining a channel within the band that extends around an interior perimeter of the band between the flange and the pavilion-facing interior surface; and a cured material filing the channel and defining a plurality of pavilion facet-mating surfaces; and a stone seated in the aperture defined by the band.

10. The jewelry piece of claim 9, wherein the jewelry base is a shank, and the jewelry piece is a ring, the jewelry base is a post, and the jewelry piece is an earring or pin, the jewelry base is a bail, and the jewelry piece is a necklace, or the jewelry base is a wristband, and the jewelry piece is a bracelet or watch.

11. A method of making a jewelry bezel setting, the method comprising:

selecting a stone, forming a band defining an aperture to receive the stone, wherein the band has an upper opening, has a lower opening, and has a stone-facing interior surface;

forming a channel within the stone-facing interior surface that extends around an interior perimeter of the band, thereby forming a flange proximate the upper opening that extends radially inward a preselected distance to seat the flange on a top edge of a girdle of the stone and forming a pavilion-facing interior surface;

placing a curable material in the channel;

seating the stone in the band with the flange on the top edge of the girdle with the girdle and pavilion facets of the stone in direct contact with the curable material; and curing the curable material with the stone seated in the band.

12. The method of claim 11, wherein the stone is a diamond or a gemstone.

13. The method of claim 11, wherein the stone is generally circular, oval, octagonal, pear, rectangular, or square at the girdle.

14. The method of claim 11, wherein curing includes applying UV or visible light to the curable material.

15. The method of claim 11, wherein forming the band includes casting the band from a mold.

16. The method of claim 11, wherein forming the band includes soldering a wire into a ring.

17. The method of claim 11, wherein forming the channel includes engraving or etching the channel into the stone-facing interior surface of the band.

18. The method of claim 10, wherein placing the curable material in the channel comprises introducing the curable material thereto as a liquid.

19. The method of claim 18, wherein the liquid is introduced by brushing the liquid in the channel with a brush, injecting the liquid into the channel with a syringe, daubing the liquid into the channel with a dauber, or filling the channel using a spatula.

20. The method of claim 19, wherein the liquid is injected into the channel through a bore that extends from an exterior of the surface of the band to the channel.

21. The method of claim 11, comprising repeating the placing of the curable material, the seating of the stone and the curing of the curable material until the channel is fully filled with cured material forming a plurality of pavilion facet-mating surfaces.

22. A method of making a jewelry bezel setting, the method comprising:

selecting a stone, forming a band defining an aperture to receive the stone, wherein the band has an upper opening, has a lower opening, and has a stone-facing interior surface comprising a channel that extends around an interior perimeter of the band, thereby forming a flange proximate the upper opening that extends radially inward a preselected distance to seat the flange on a top edge of a girdle of the stone and forming a pavilion-facing interior surface;

placing a curable material in the channel;

seating the stone in the band with the flange on the top edge of the girdle with the girdle and pavilion facets of the stone in direct contact with the curable material; and curing the curable material with the stone seated in the band.

23. The method of claim 22, wherein forming the band includes defining the channel using 3D software for a mold and molding the band, or 3D printing the band.

* * * * *